US010150299B2

(12) United States Patent
Atsuta

(10) Patent No.: US 10,150,299 B2
(45) Date of Patent: Dec. 11, 2018

(54) LIQUID EJECTION HEAD MANUFACTURE METHOD AND LIQUID EJECTION HEAD

(71) Applicant: CANON KABUSHIKI KAISHA, Tokyo (JP)

(72) Inventor: Tomohisa Atsuta, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/623,726

(22) Filed: Jun. 15, 2017

(65) Prior Publication Data

US 2018/0009228 A1 Jan. 11, 2018

(30) Foreign Application Priority Data

Jul. 7, 2016 (JP) ..... 2016-135334

(51) Int. Cl.

| | |
|---|---|
| ***B41J 2/175*** | (2006.01) |
| ***B41J 2/16*** | (2006.01) |
| *B41J 2/20* | (2006.01) |

(52) U.S. Cl.

CPC ..... *B41J 2/17563* (2013.01); *B41J 2/162* (2013.01); *B41J 2/1637* (2013.01); *B41J 2/1752* (2013.01); *B41J 2/17513* (2013.01); *B41J 2/17553* (2013.01); *B41J 2/20* (2013.01)

(58) Field of Classification Search

CPC ..... B41J 2/17563; B41J 2/162; B41J 2/1637; B41J 2/17513; B41J 2/1752; B41J 2/17553

See application file for complete search history.

(56) References Cited

U.S. PATENT DOCUMENTS 7,958,634 B2 6/2011 Kobayashi et al.

FOREIGN PATENT DOCUMENTS

| | | |
|---|---|---|
| JP | 8-080616 A | 3/1996 |
| JP | 2010-94973 A | 4/2010 |

*Primary Examiner* — Thinh H Nguyen
(74) *Attorney, Agent, or Firm* — Venable LLP

(57) ABSTRACT

When a filter for example is provided in a liquid supply path in the manufacture of a liquid ejection head, the filter can be prevented from being displaced or deformed. A manufacture method of a liquid ejection head having a liquid ejection unit for ejecting liquid and a liquid supply unit for supplying liquid to the liquid ejection unit has a processing of abutting a filter to a melting unit provided in the liquid supply unit and applying heat to the melting unit via the filter to melt the melting unit to thereby fix the filter to the melting unit, and a processing of burying the melting unit fixed to the filter by molding material.

13 Claims, 11 Drawing Sheets

LIQUID EJECTION HEAD MANUFACTURE METHOD AND LIQUID EJECTION HEAD

BACKGROUND OF THE INVENTION

Field of the Invention

The present invention relates to a liquid ejection head manufacture method and a liquid ejection head. In particular, the invention relates to a technique to a position and fix a filter used in a liquid supply path for example of a liquid ejection head.

Description of the Related Art

A filter of a liquid ejection head is used to remove dust or bubbles included in liquid flowing in a liquid supply path. This prevents liquid ejected through a liquid ejection head from being mixed with dust or bubbles, maintaining a favorable ejection characteristic. This filter is generally provided so as to be sandwiched between two resin mold components constituting a liquid supply path.

Japanese Patent Laid-Open No. 2010-94973 discloses a method to position and fix a filter. Specifically, a resin mold component includes a pin for a positioning purpose and the pin is inserted to a hole formed in a filter and is positioned. Then, the filter is sandwiched between two liquid supply members and the periphery thereof is subsequently bound and buried by molding resin to thereby position and fix the filter.

However, in the case of a method using the pin disclosed in Japanese Patent Laid-Open No. 2010-94973 for a positioning purpose, the use of the pin and the hole of the filter to which the pin is inserted may cause a disadvantage of the displacement or deformation of the filter. Specifically, there may be a case where the shape of a constituting component or the configuration of a molding machine requires members to be assembled while being moved in a horizontal direction. In such a case, the filter is undesirably moved in a horizontal direction while a pin is being engaged in the hole of the filter, which may cause the displacement of the filter. In the worst case, the filter may be disengaged from the regular position. Furthermore, in a step of providing a hole in a filter, the stress acts on the filter, which may cause the deformation of the filter. In this case, a disadvantage is caused such as a deteriorated filter collecting performance or dust generation.

SUMMARY OF THE INVENTION

The present invention solves the above disadvantage. Specifically, the invention provides a liquid ejection head manufacture method and a liquid ejection head by which a filter for example can be provided in a liquid supply path without causing the displacement or deformation of the filter.

In the first aspect of the present invention, there is provided a manufacture method of a liquid ejection head having a liquid ejection unit for ejecting liquid and a liquid supply unit for supplying liquid to the liquid ejection unit, comprising: a step of abutting a filter to a melting unit provided in the liquid supply unit and applying heat to the melting unit via the filter to melt the melting unit to thereby fix the filter to the melting unit; and a step of burying the melting unit fixed to the filter by molding material.

In the second aspect of the present invention, there is provided a liquid ejection head having a liquid ejection unit for ejecting liquid and a liquid supply unit for supplying liquid to the liquid ejection unit, comprising: a projection-like melting unit provided in the liquid supply unit; a filter joined to the melting unit while being molten; and molding material in which the melting unit fixed to the filter is buried.

The configuration as described above allows, in the manufacture of a liquid ejection head, a filter for example to be provided in a liquid supply path without causing the displacement or deformation of the filter.

Further features of the present invention will become apparent from the following description of exemplary embodiments with reference to the attached drawings.

DESCRIPTION OF THE EMBODIMENTS

The following section will describe an embodiment of the present invention in detail with reference to the drawings.

First Embodiment

Figure 1:
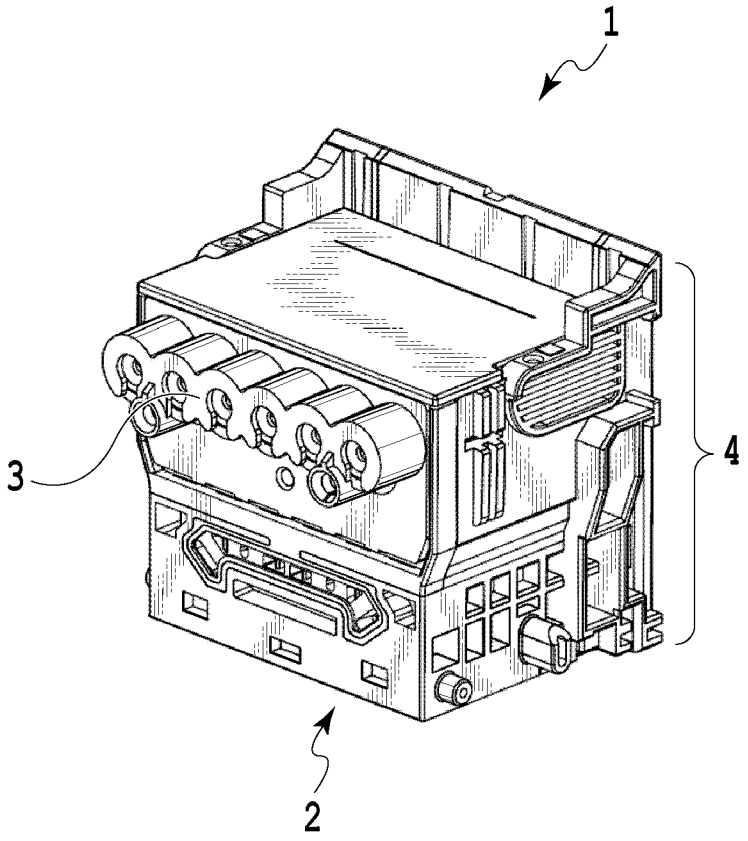
FIG. 1 is a perspective view illustrating a liquid ejection head according to one embodiment of the present invention.

FIG. 1 is a perspective view illustrating a liquid ejection head 1 according to one embodiment of the present invention. The liquid ejection head 1 includes a liquid supply unit 4 to introduce ink supplied from a printing liquid storage container (not shown) via a tube for example (not shown) connected to a liquid introduction opening 3. In FIG. 1, the liquid ejection head 1 includes, at a lower end position, a liquid ejection unit 2 to eject printing liquid. The liquid supply unit 4 includes therein a flow path that provides the liquid communication between the liquid introduction opening 3 and the liquid ejection unit 2.

Figure 2:
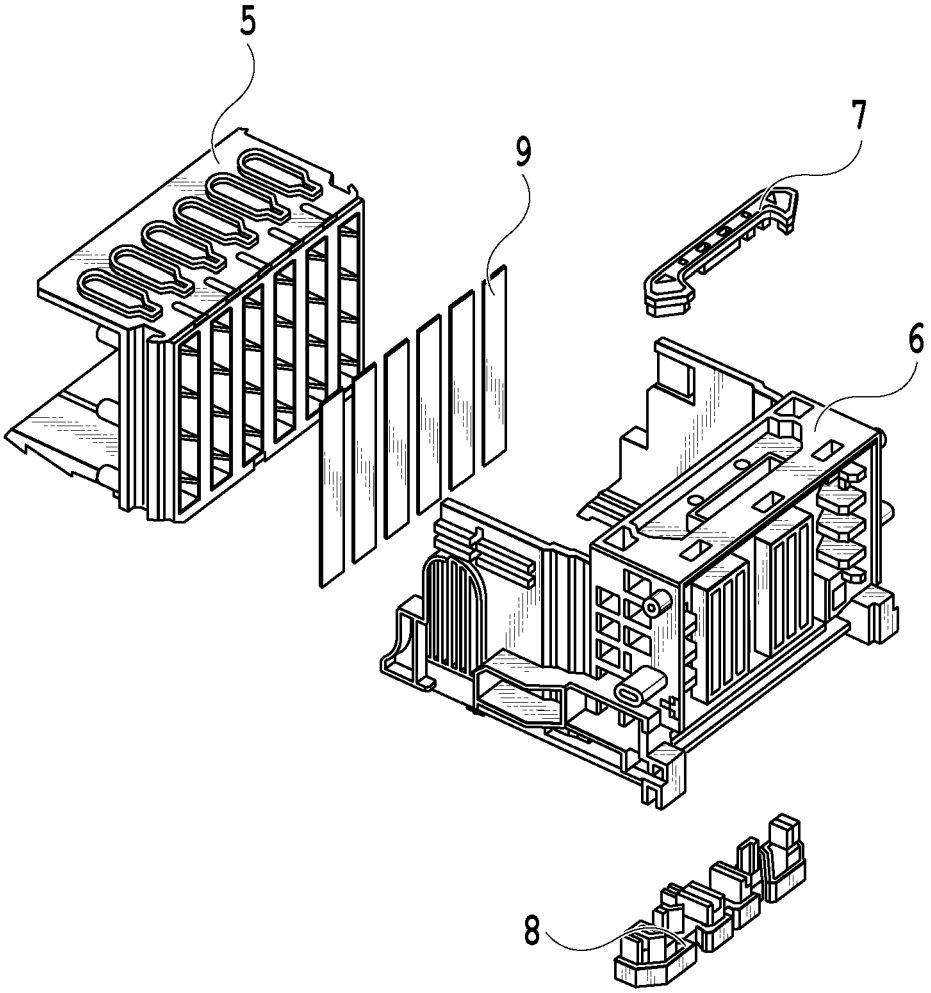
FIG. 2 is an exploded perspective view illustrating a liquid supply unit shown in FIG. 1.

FIG. 2 is an exploded perspective view illustrating the liquid supply unit 4 shown in FIG. 1. The liquid supply unit 4 is configured to have a liquid supply member 5, a liquid supply member 6, a flow path cover member 7, a flow path cover member 8, a filter 9, and a liquid introduction opening member 10. The filter 9 of this embodiment is formed to have a three-layer (or multi-layer) structure of metal fibers. The filter 9 has, at the center thereof, a sintered non-woven fabric SUS filter (having a collecting capacity of about 7μ) manufactured to have a diameter of 4 microns having a high dust collecting capacity and has, at both outer faces, a sintered non-woven fabric SUS filter (having a collecting capacity of about 30μ) manufactured to have a diameter of 12 microns for the purpose of maintaining the rigidity, respectively. The filter form is not limited to this and can be selected in consideration of a required collecting efficiency or size stability or the handling by a robot for example inserted to a filter mold. For example, the filter form also may be a 2-layer structured non-woven fabric of metal material fibers, a single-layered woven mesh structure, or non-woven fabric of resin material, or a single-layer woven mesh for example or also may be resin material such as a porous film.

The liquid supply member 5, the liquid supply member 6, and the flow path cover member 8 in the liquid supply unit 4 described above is manufactured by a mold and a molding process using resin as molding material described below. In this manufacture step, the filter 9 is positioned and fixed between the liquid supply member 5 and the liquid supply member 6.

Figure 3:
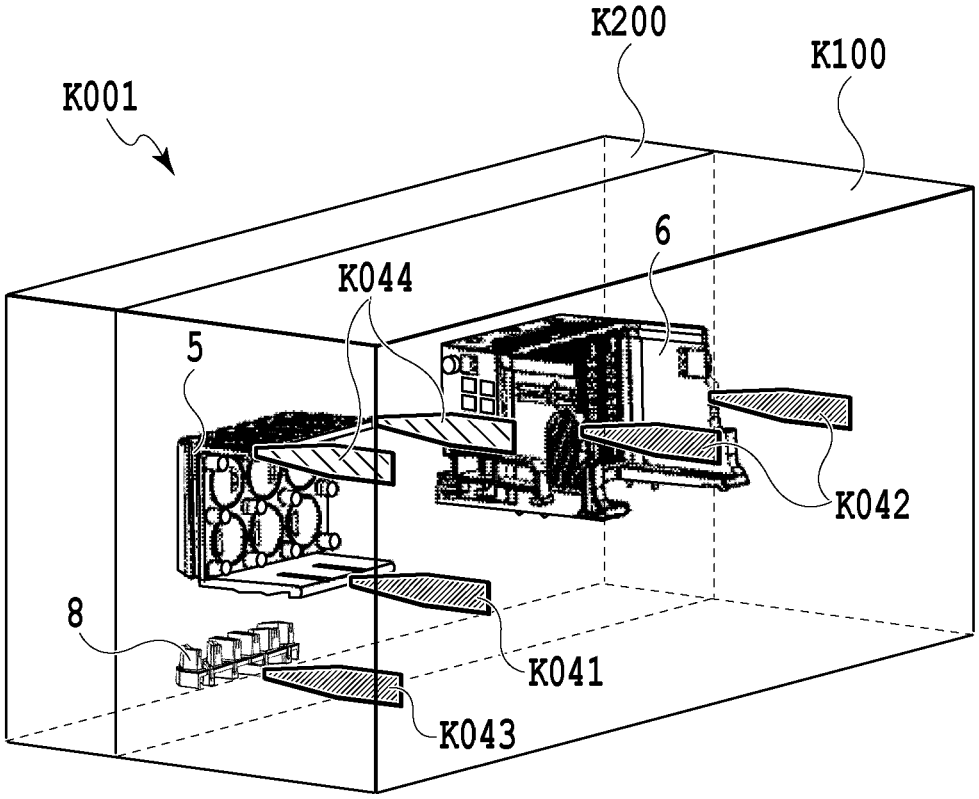
FIG. 3 is a perspective view schematically illustrating the configuration of a mold used in the manufacture of the liquid supply unit according to the first embodiment of the present invention.
Figure 4A:
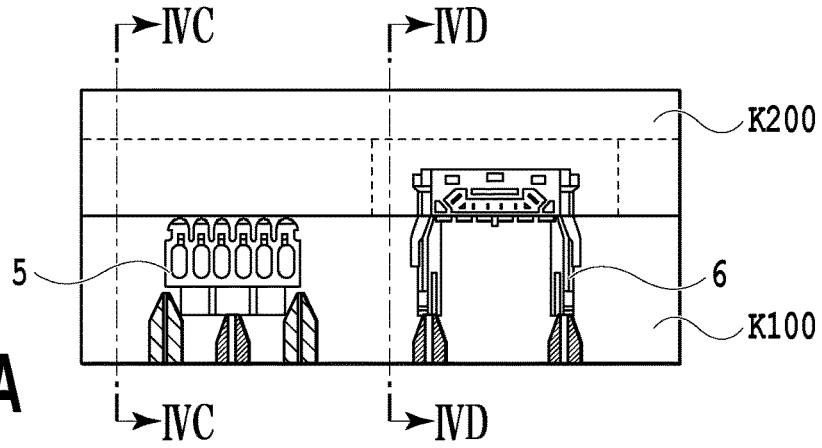
FIG. 4A to FIG. 4D illustrate an upper face, a front face, an IVC-IVC cross section, and an IVD-IVD cross section of a mold after a primary molding according to the first embodiment, respectively.
Figure 4B:
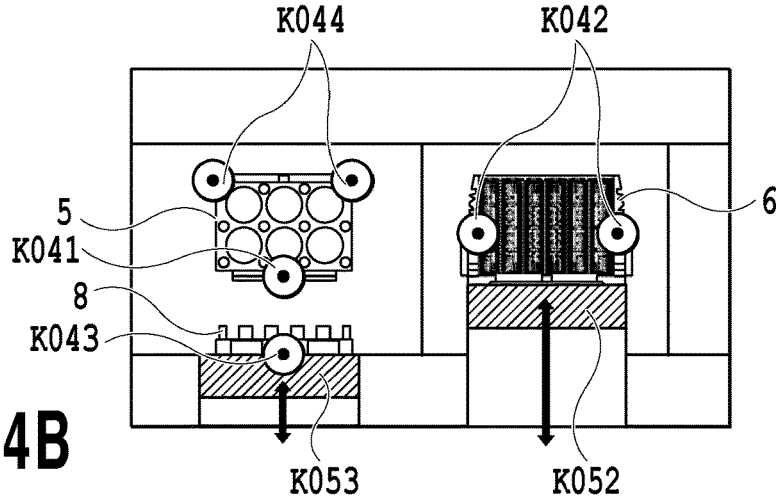
Figure 4C:
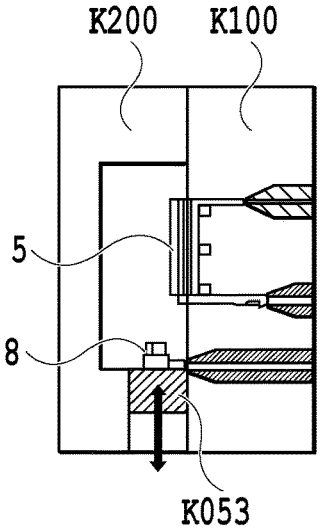
Figure 4D:
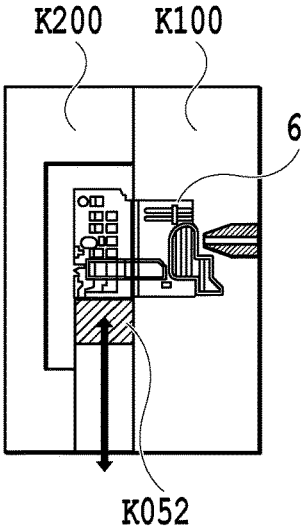

FIG. 3 is a perspective view schematically illustrating the configuration of a mold K001 used in the manufacture of the liquid supply unit according to the first embodiment of the present invention. The mold K001 includes a primary molding gate K041 for molding the liquid supply member 6, a primary molding gate K042 for molding the liquid supply member 5, and a primary molding gate K043 for molding the flow path cover member 8. The mold K001 further includes a secondary molding gate K044 to perform a sealing joint operation. The mold K001 of this embodiment is composed of a fixed-side mold K100 and a movable-side mold K200. The movable-side mold K200 includes a die slide configuration (not shown). The fixed-side mold K100 and the movable-side mold K200 are configured so as to be openable and closable for mold opening and mold clamping operations. The movable-side mold K200 is configured so as to be die-slidable relative to the fixed-side mold K100. The mold K001 has pieces (5, 6) for molding the liquid supply members 5 and 6, respectively, and a shape piece (8) for molding the flow path cover member 8 that are arranged in the fixed-side mold K100 or the movable-side mold K200, respectively. In this embodiment, these die slide and slide piece are moved using a hydraulic cylinder and an electric cylinder.

FIG. 4A to FIG. 4D illustrate an upper face, a front face, an IVC-IVC cross section, and an IVD-IVD cross section of the mold K001 after the primary molding, respectively. A slide piece K052 is a piece to form a curved flow path of the liquid supply member 6. A slide piece K053 is a piece to retain the flow path cover member 8 and to assemble the flow path cover member 8 to the liquid supply member 5. The slide piece K053 is configured so as to be movable in the same direction as that of the slide piece K052.

FIG. 5A to FIG. 5D illustrate steps to mold and assemble the flow path member using the mold K001 described above with reference to FIG. 3 and FIG. 4A to FIG. 4D.

Figure 5A:
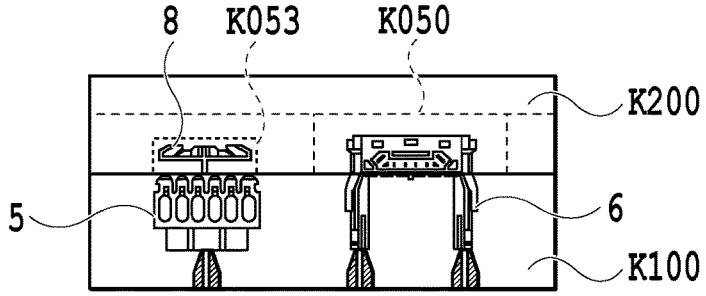
FIG. 5A to FIG. 5D illustrate steps to mold and assemble a flow path member using the molds shown in FIG. 3 and FIG. 4A to FIG. 4D.
Figure 5B:
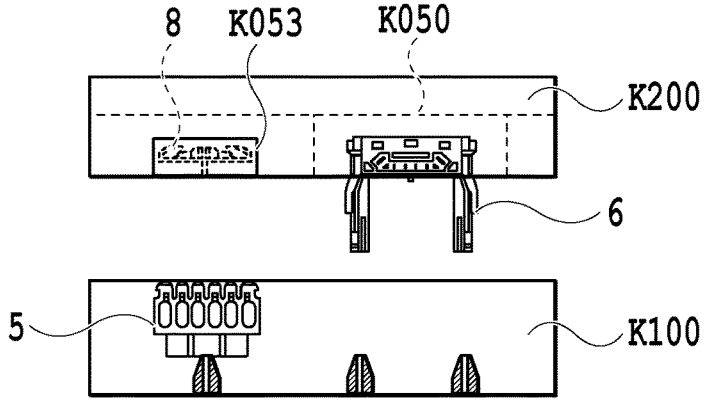

FIG. 5A illustrates a state in which the primary molding is completed. Specifically, FIG. 5A illustrates a state in which three resin molding components of the liquid supply member 5, the liquid supply member 6, and the flow path cover member 8 are molded in a mold. FIG. 5B illustrates a state in which the mold is opened after the step shown in FIG. 5A. The molded liquid supply member 5 is retained by the fixed-side mold K100. The liquid supply member 6 and the flow path cover member 8 molded in a similar manner are retained by the movable-side mold K200. During this, the flow path cover member 8 is moved in the downward direction and is in a stand-by state while being retained by the slide piece K053 attached to the movable-side mold K200.

Figure 5C:
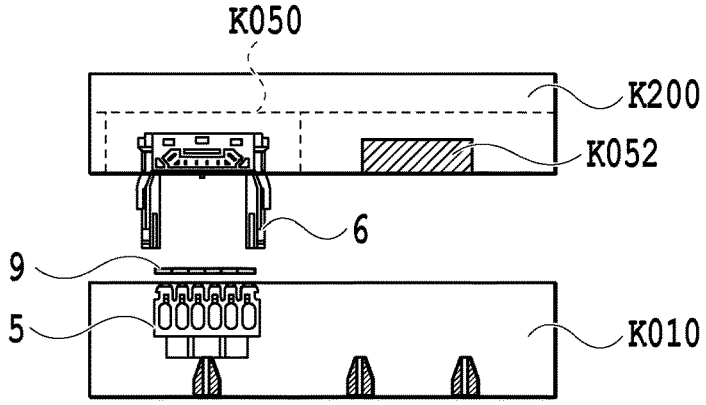

FIG. 5C illustrates a state in which a die slide operation is performed while the mold is being opened shown in FIG. 5B. Specifically, the liquid supply member 6 retained by the movable-side mold K200 is subjected to a die slide movement to a position opposed to the liquid supply member 5 retained by the fixed-side mold K100. The slide piece K053 is caused to slide and the flow path cover member 8 is abutted to the liquid supply member 5. In this state, as will be described in detail later, the filter 9 is abutted to the melting unit of the liquid supply member 5 and the melting unit is caused to melt. Then, the filter is temporarily fixed to this molten melting unit. The filter can be abutted and temporarily fixed by a robot hand in accordance with the molding timing.

Figure 5D:
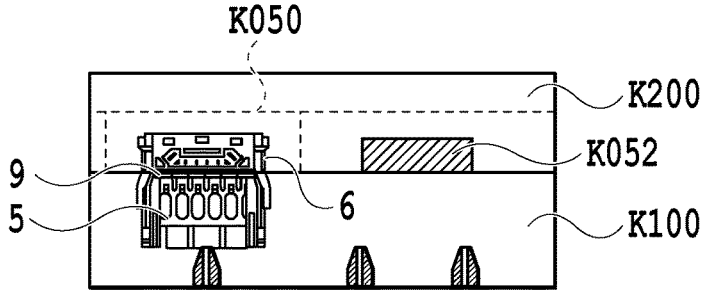

FIG. 5D illustrates a state in which the mold is clamped again after the state shown in FIG. 5C. The secondary molding is performed in this state. In the secondary molding, secondary molding resin is ejected to a junction of the liquid supply members 5 and 6 for example during which the filter 9 is also fixed.

Figure 6A:
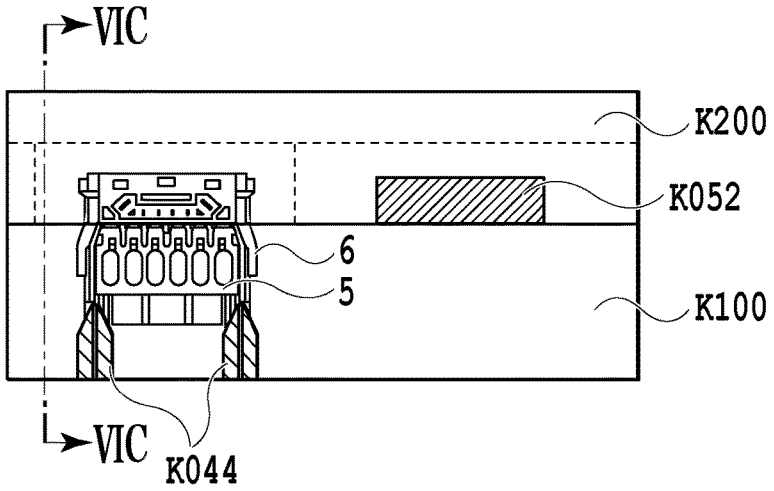
FIG. 6A to FIG. 6C illustrate an upper face, a front face, and a VIC-VIC cross section of the mold during the secondary molding according to the first embodiment, respectively.
Figure 6B:
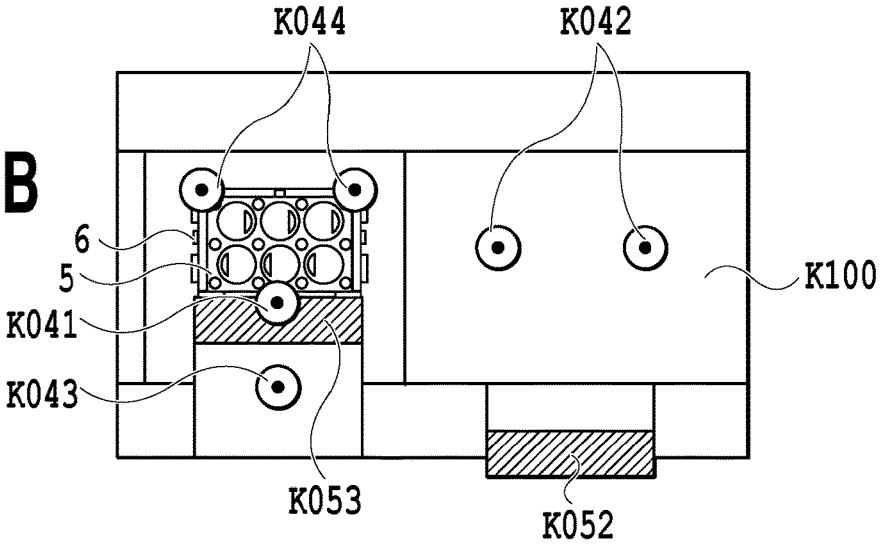
Figure 6C:
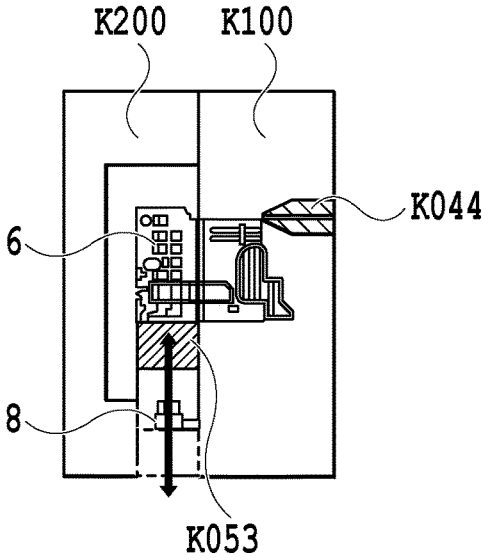
Figure 7:
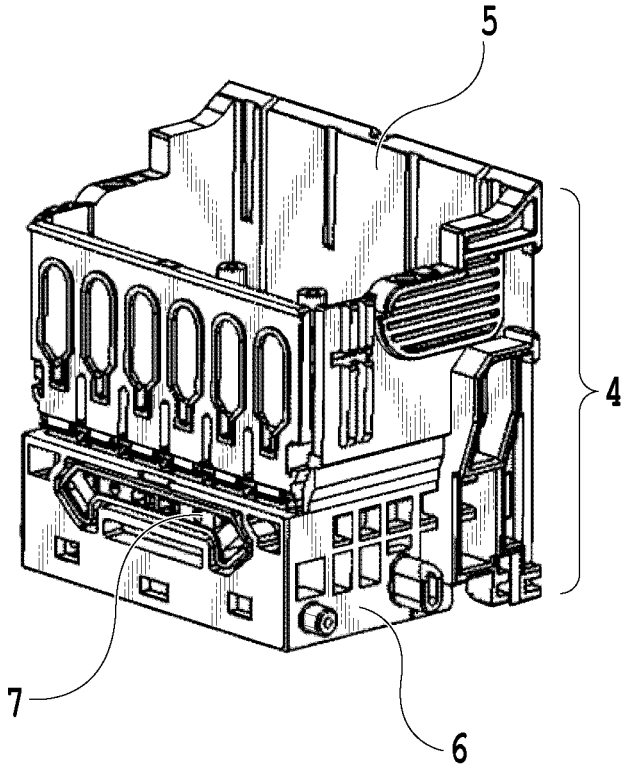
FIG. 7 is a perspective view illustrating the liquid supply unit completed by the molding of the first embodiment.

FIG. 6A to FIG. 6C illustrate an upper face, a front face, and a VIC-VIC cross section of the mold K001 during the secondary molding, respectively. The secondary molding resin is injected from a secondary resin gate K044 to seal and integrate the three resin components of the liquid supply member 5, the liquid supply member 6, and the flow path cover member 8. This consequently completes the liquid supply unit 4 as shown in FIG. 7.

FIG. 8A to FIG. 8D relate to the first embodiment of the present invention and illustrate the steps shown in FIG. 5C and FIG. 5D and in particular the details of the steps from the positioning and temporary fixing of the filter 9 to the fixing by the secondary molding.

Figure 8A:
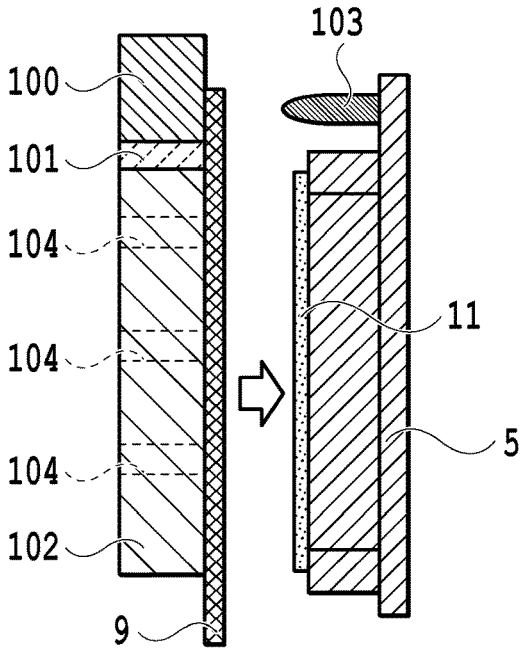
FIG. 8A to FIG. 8D show the details of operations from the positioning and temporary fixing to fixation in the secondary molding of the filter according to the first embodiment of the present invention.

FIG. 8A shows the state prior to the junction of the filter 9 held by a robot hand to the liquid supply member 5 in the step shown in FIG. 5C. In particular, a welding jig is configured to have a heating unit 100, a heat insulating unit 101, and an adsorption unit 102. The welding jig is held by a not-shown robot hand and uses the adsorption unit 102 to adsorb and retain the filter 9.

Figure 8B:
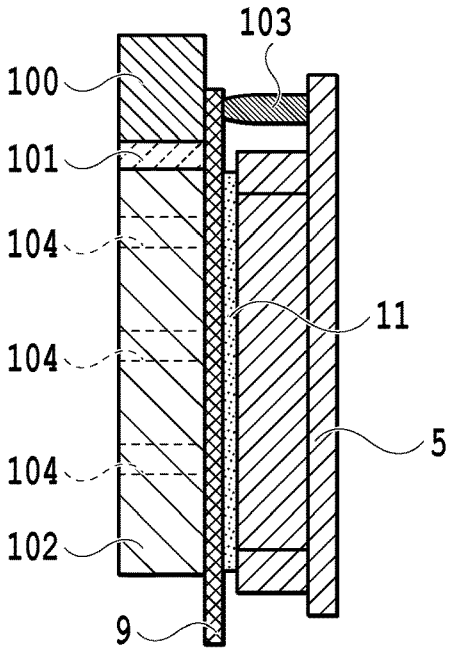

Next, as shown in FIG. 8B, the robot hand is moved to abut the filter 9 retained by the welding jig to the liquid supply member 5. Then, the heat of the heating unit 100 is used to heat and melt a melting unit 103 provided in the liquid supply member 5 via the filter 9. As a result, the filter 9 can be positioned and temporarily fixed to the liquid supply member 5. This temporary fixing prevents a situation where the filter is displaced in the subsequent step. The melting unit 103 has a projection-like shape as shown in the drawing protruded from the position where the melting unit 103 is provided.

Figure 8C:
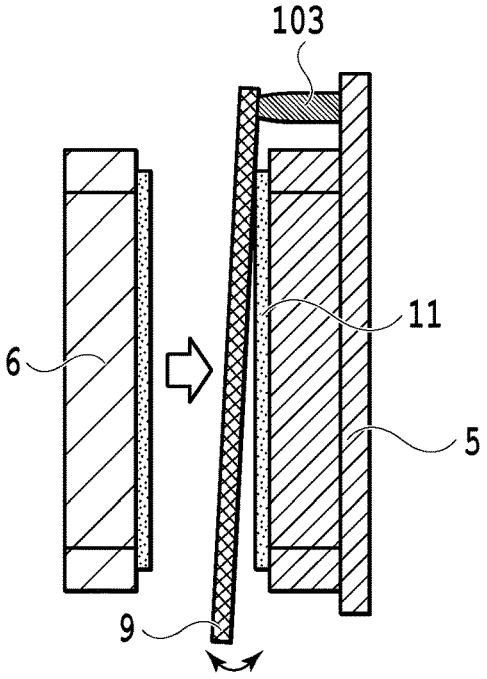

After this positioning/temporary fixing, a mold-closing step (FIG. 5C to FIG. 5D) is used to provide, as shown in FIG. 8C, the filter 9 abutted and sandwiched between the liquid supply member 6 and the liquid supply member 5. At this stage, the filter 9 is not welded to a sealing face 11 of the liquid supply member 5 and has only one longitudinal side welded in a fixed manner. This allows, when the liquid supply member 6 has a contact with the sealing face of the liquid supply member 5, the filter 9 to be in a free state. This prevents stress causing deformation for example and, even when such stress occurs, the force of the stress can be released.

Figure 8D:
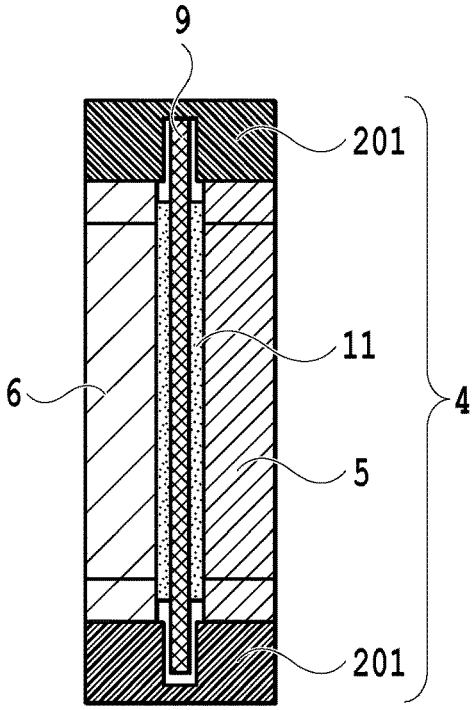

Next, as shown in FIG. 8D, the mold is closed while the filter 9 is being in a free state. A secondary molding resin 201 is used to connect and seal the liquid supply member 5 and the liquid supply member 6 to thereby form a liquid supply unit. During this, a part at which the filter 9 is temporarily fixed is buried with the secondary molding resin, thereby fixing the filter 9 to the liquid supply member 5.

Figure 9A:
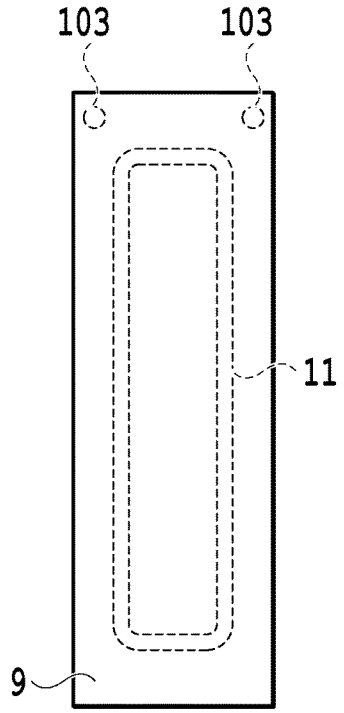
FIG. 9A to FIG. 9D illustrate the shape and layout of a melting unit provided in the liquid supply member according to the first embodiment.
Figure 9B:
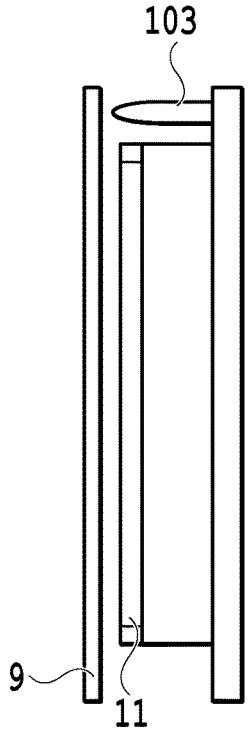
Figure 9C:
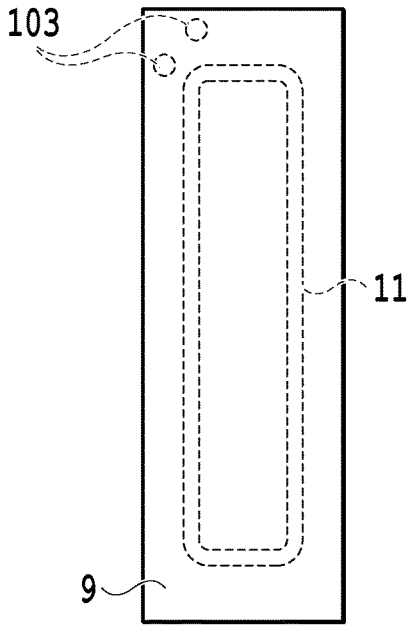
Figure 9D:
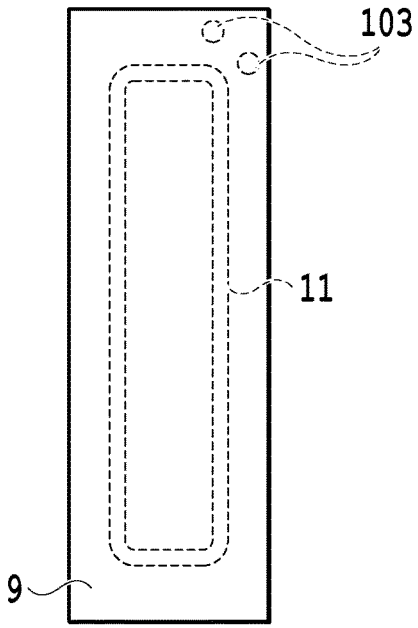

FIG. 9A to FIG. 9D illustrate the shape and layout of the melting unit 103 provided in the liquid supply member 5. In this embodiment, as shown in FIG. 9A and FIG. 9B, two projections (the melting units 103) are arranged at a position that is away from the sealing face 11 and that is buried with the resin during the secondary molding. The two melting unit 103 also may be arranged, as shown in FIG. 9C and FIG. 9D, so as to be adjacent to each other at one corner in the longitudinal direction of the filter 9.

Such a jig configuration to weld the projection-like melting unit as described above is desired, as described above with reference to FIG. 8A, in which the heating unit 100, the heat insulating unit 101, and the adsorption unit 102 are formed to provide an integrated structure and no deformation is caused during the filter adsorption. By the jig having an integrated structure, the jig can be abutted to the sealing face 11 of the liquid supply member 105 to absorb the component tolerance of the sealing face 11 and the melting unit 103 in the height direction and can weld the melting unit 103 simultaneously with the abutment.

Second Embodiment

Figure 10:
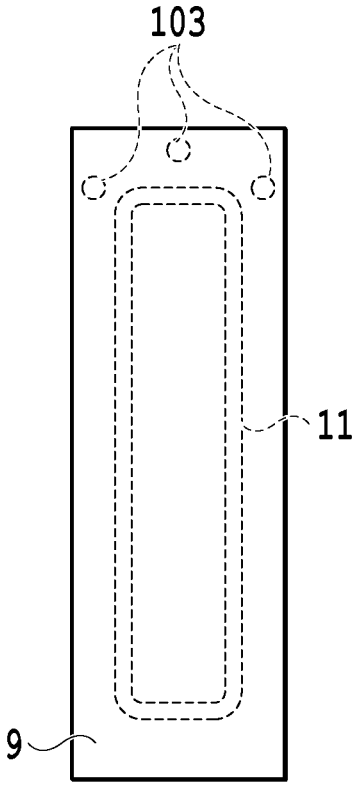
FIG. 10 illustrates the shape and layout of the melting unit provided in the liquid supply member according to the second embodiment of the present invention; and FIG. 11A to FIG. 11D illustrates the shape of the filter and the layout of the melting unit according to another embodiment.
Figure 11A:
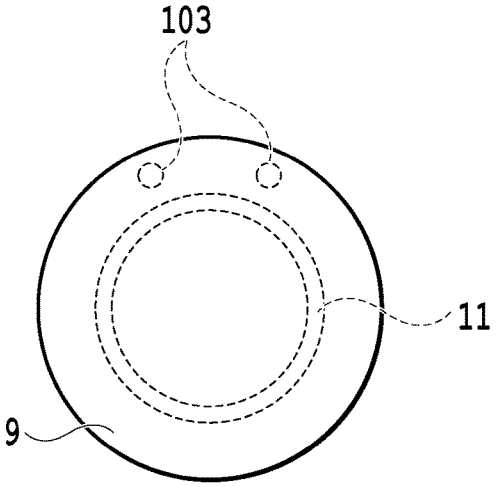
Figure 11B:
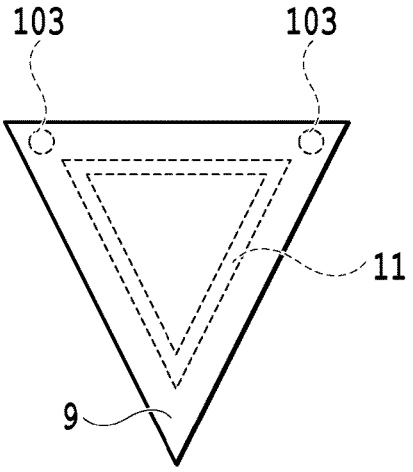
Figure 11C:
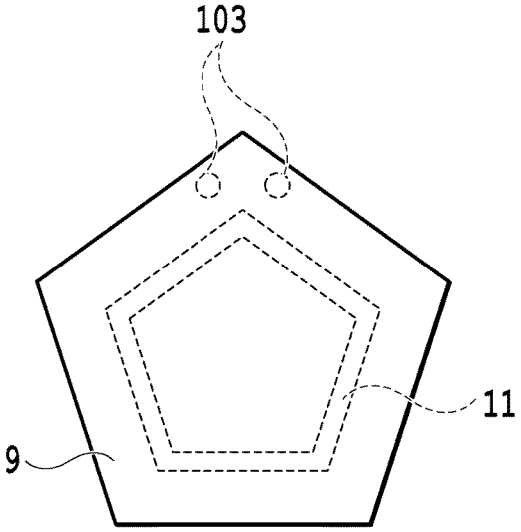
Figure 11D:
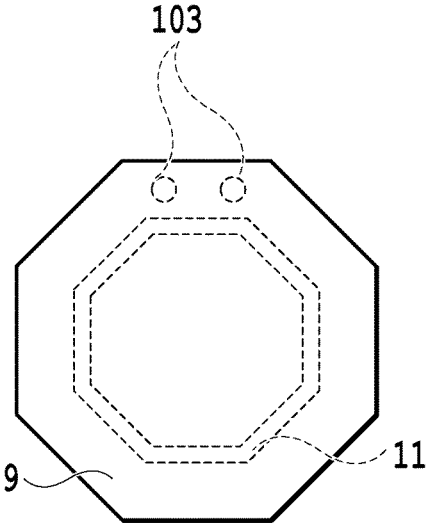

FIG. 10 illustrates the shape and layout of the melting unit 103 provided in the liquid supply member 5 according to the second embodiment of the present invention. As shown in FIG. 10, as in the first embodiment, three projections (the melting units 103) are arranged at a position that is away from the sealing face 11 and that is buried with the resin during the secondary molding. This embodiment is suitable for a case where a positioning operation requiring a higher accuracy than those of the two layouts of the first embodiment is performed and a case where the filter 9 has a high weight. Thus, four or more projections (the melting units 103) also may be arranged.

Another Embodiment

FIG. 11A to FIG. 11D illustrate the layout of the shape of the filter and the melting unit according to another embodiment. In the above-described first and second embodiments, the filter has a rectangular shape. However, the filter also can have a shape determined depending on the shape or layout of the flow path of the liquid supply member. Thus, the shape and layout of the sealing face also can be determined depending on the determined filter shape. In this case, the melting unit provided in the liquid supply member is arranged at a position that is away from the sealing face and that is buried with resin during the secondary molding.

The melting unit may be provided not in the liquid supply member 5 but in the liquid supply member 6. Specifically, the melting unit can be provided in any of the liquid supply members 5 and 6.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-135334, filed Jul. 7, 2016, which is hereby incorporated by reference wherein in its entirety.

What is claimed is:

1. A manufacture method of a liquid ejection head having a liquid ejection unit for ejecting liquid and a liquid supply unit for supplying liquid to the liquid ejection unit, comprising:

a step of abutting a filter to a tip portion of a melting unit having a projection shape provided in the liquid supply unit and applying heat to the melting unit via the filter to melt the tip portion of the melting unit to thereby fix the filter to the melting unit; and a step of burying the melting unit fixed to the filter in a molding material.

2. The manufacture method of the liquid ejection head according to claim 1, wherein:

the melting unit protrudes from a position at which the melting unit is provided in the liquid supply unit.

3. The manufacture method of the liquid ejection head according to claim 1, wherein:

the filter is fixed between liquid supply members that constitute the liquid supply unit and that are opposed to each other and the melting unit is provided in one of the opposed liquid supply members.

4. The manufacture method of the liquid ejection head according to claim 3, wherein:

the burying step is a step that is performed, in a step of using a mold to mold the liquid supply unit, in a step of ejecting the molding material after a mold clamping step for joining the opposed liquid supply members.

5. The manufacture method of the liquid ejection head according to claim 4, wherein:

the melting unit is provided at a position that is buried with the molding material in the ejecting step.

6. The manufacture method of the liquid ejection head according to claim 1, wherein:

the liquid supply unit includes first and second liquid supply members; and the method further comprises a molding step of ejecting a liquid supply member molding material into a mold to mold the first and second liquid supply members.

7. The manufacture method of the liquid ejection head according to claim 6, wherein:

the molding step is followed by a step of opening the mold and clamping the mold while the first and second liquid supply members are left in the mold to perform the burying step.

8. A liquid ejection head having a liquid ejection unit for ejecting liquid and a liquid supply unit for supplying liquid to the liquid ejection unit, comprising:

a projection-shaped melting unit provided in the liquid supply unit;

a filter joined to a tip portion of the melting unit while being molten; and a molding material in which the melting unit fixed to the filter is buried.

9. The liquid ejection head according to claim 8, wherein:

the filter is fixed between liquid supply members that constitute the liquid supply unit and that are opposed to each other and the melting unit is provided in one of the opposed liquid supply members.

10. The liquid ejection head according to claim 8, wherein:

the filter is a structure formed by weaving single-layer fibers.

11. The liquid ejection head according to claim 10, wherein:

the filter comprises resin material fibers.

12. The liquid ejection head according to claim 8, wherein:

the filter is a structure formed by sintering multi-layer fibers.

13. The liquid ejection head according to claim 8, wherein:

the filter comprises metal material fibers.

* * * * *